United States Patent [19]

Johnson

[11] 4,341,171

[45] Jul. 27, 1982

[54] THREAD HANDLING DEVICE FOR LOCKSTITCH SEWING MACHINES

[75] Inventor: Ralph E. Johnson, Convent Station, N.J.

[73] Assignee: The Singer Company, Stamford, Conn.

[21] Appl. No.: 259,299

[22] Filed: Apr. 30, 1981

[51] Int. Cl.[3] ..... D05B 49/00

[52] U.S. Cl. ..... 112/250; 112/254

[58] Field of Search ..... 112/250, 241, 247, 270, 112/254, 57, 58

[56] References Cited

U.S. PATENT DOCUMENTS

| | | | |
|---|---|---|---|
| 171,558 | 12/1875 | Gibbs | 112/254 X |
| 276,113 | 4/1883 | Wilcox et al. | 112/241 X |
| 331,026 | 11/1885 | Bigelow | 112/241 X |
| 560,793 | 5/1896 | Hardy | 112/254 |
| 908,434 | 12/1908 | Woodward | 112/241 |
| 2,566,005 | 8/1951 | Ward | 112/254 X |
| 2,566,006 | 8/1951 | Ward | 112/254 X |
| 2,581,142 | 1/1952 | Rea | 112/254 X |
| 3,561,385 | 2/1971 | Johnson | 112/247 |
| 3,587,495 | 6/1971 | Johnson | 112/241 X |
| 4,263,859 | 4/1981 | Johnson | 112/250 X |

FOREIGN PATENT DOCUMENTS

| | | | |
|---|---|---|---|
| 48-111356 | 12/1973 | Japan | 112/254 |
| 54-123059 | 8/1979 | Japan | 112/254 |
| 54-179861 | 12/1979 | Japan | 112/254 |
| 54-179862 | 12/1979 | Japan | 112/254 |
| 55-23506 | 6/1980 | Japan | 112/254 |

*Primary Examiner*—H. Hampton Hunter

*Attorney, Agent, or Firm*—William V. Ebs; Robert E. Smith; Edward L. Bell

[57] ABSTRACT

A sewing machine is provided with a thread handling device having a thread holding and a thread metering function. The device includes a pair of parallel elongate members, and a length of easily compressible resilient material which is carried by one of the members and compressed against the other member. Needle thread extending between the resilient material and said other member is subjected to frictional resistance by the resilient material during movement in the device.

9 Claims, 6 Drawing Figures

Fig. 1
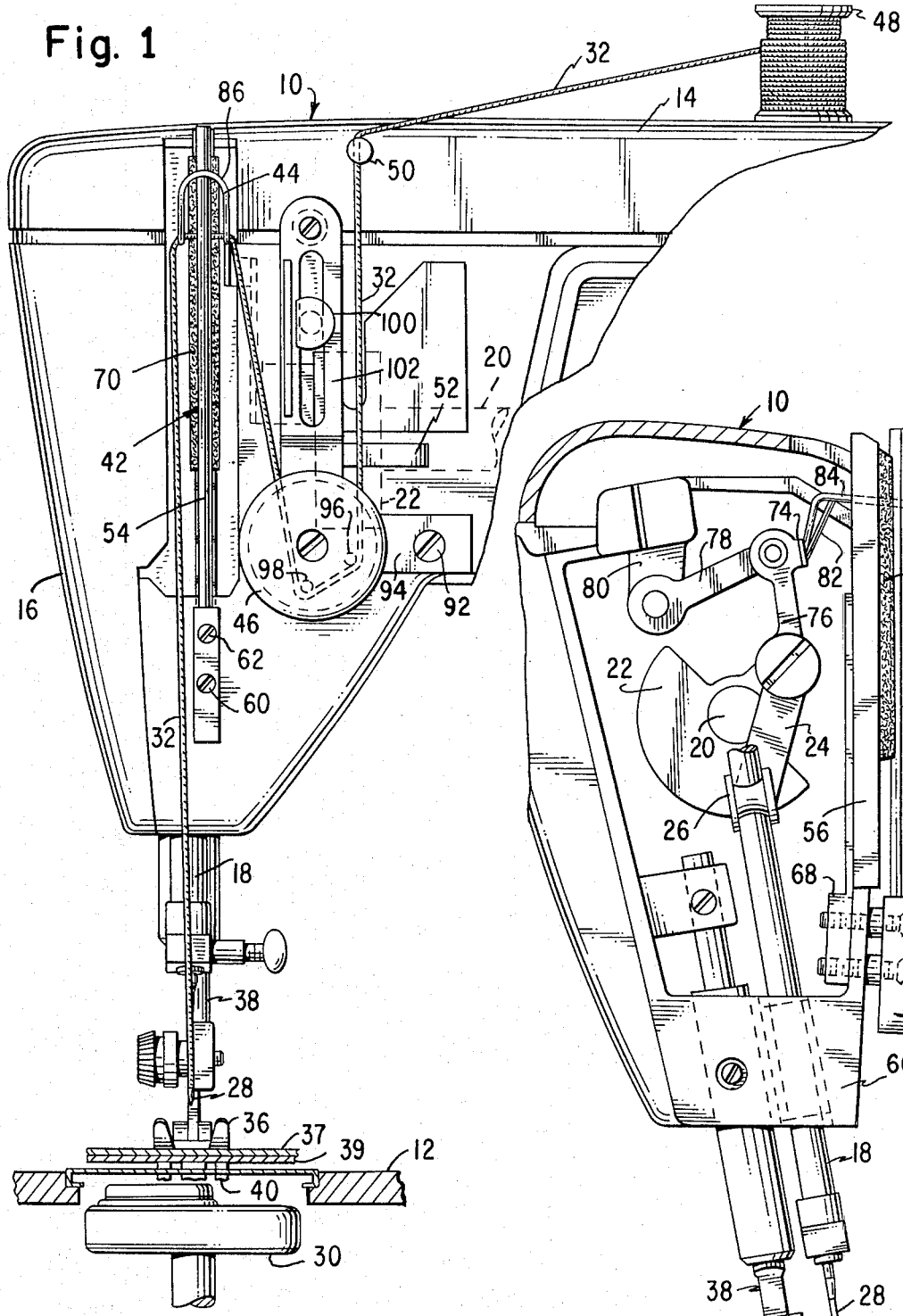
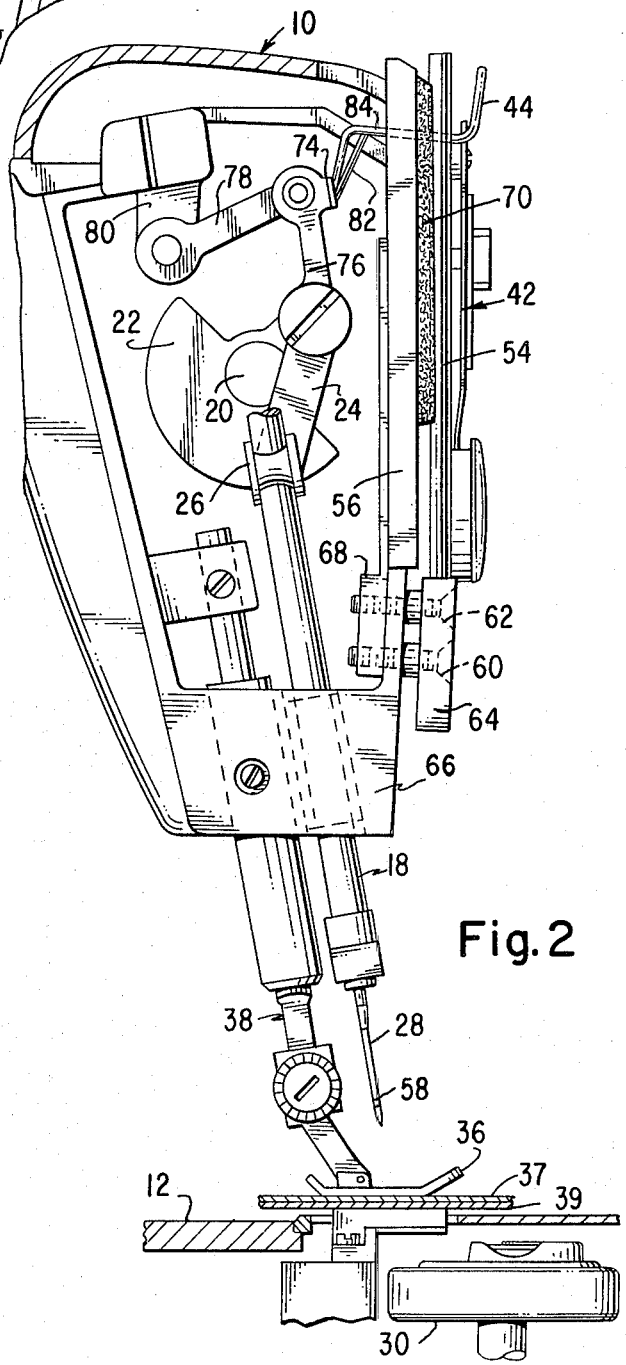
Fig. 2

Fig. 3
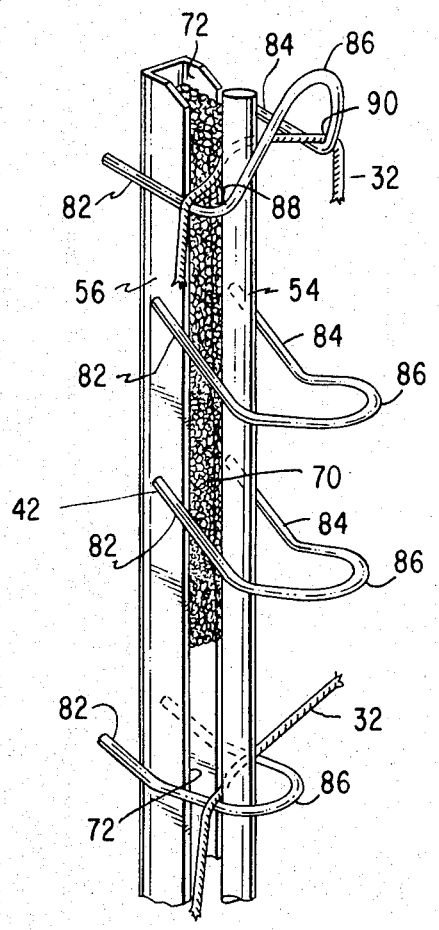
Fig. 4
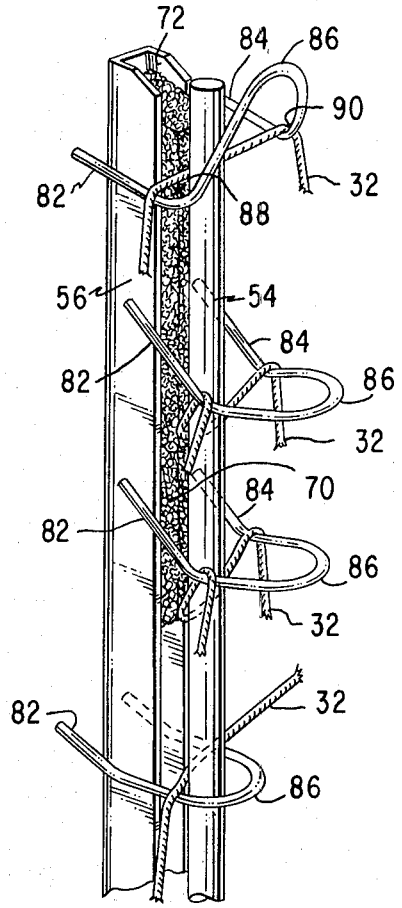
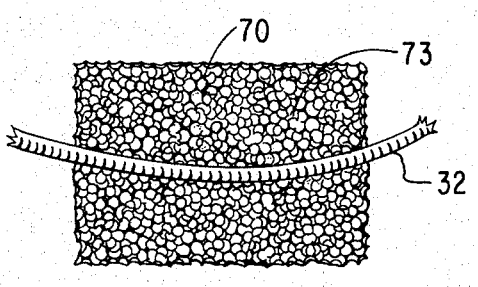
Fig. 5
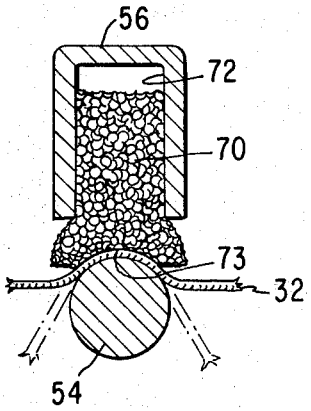
Fig. 6

THREAD HANDLING DEVICE FOR LOCKSTITCH SEWING MACHINES

DESCRIPTION

BACKGROUND OF THE INVENTION

1. Field of the Invention

The invention is directed to a thread handling device for use in lockstitch sewing machines.

2. Description of the Prior Art

U.S. Pat. No. 4,263,859 of Ralph E. Johnson for "Thread Handling System for a Sewing Machine", issued Apr. 28, 1981, discloses a thread handling system which includes a thread handling device with elongate members that serve to hold and to meter needle thread to a needle and looptaker of a lockstitch sewing machine. The system further includes a thread tensioner. Thread from a spool extends to the thread tensioner, and beyond the tensioner the thread extends to the thread handling device. Beyond the thread handling device, the thread extends to the needle. A takeup, which brackets the thread handling device, sets stitches and pulls thread through the tensioner. The takeup moves the thread in one direction in the thread handling device to a stitch position at one end of its operating range, and moves in the opposite direction free of thread to the other end of its operating range, after which thread in the device moves to a position of reengagement with the takeup to shorten the path for thread between the tensioner and needle such that a quantity of thread is thereby supplied for use by the needle and looptaker.

It is a prime object of the present invention to provide an improved thread handling device of the kind disclosed in the said patent of Ralph E. Johnson which functions with simplified structure to apply a light and substantially uniform frictional force to needle thread during movement of the thread therein.

It is another object of the invention to so construct a thread handling device of the kind described in said patent as to avoid the adherence to close dimensional tolerances, during manufacture and assembly thereof, as a requirement for the production of a device capable of finely controlling thread moving through it.

It is still another object of the invention to so construct a thread handling device of the kind indicated as to avoid the need therein for a movable thread engaging member and biasing spring for such movable member.

Other objects and advantages of the invention will become apparent during a reading of the specification taken in connection with the accompanying drawings.

SUMMARY OF THE INVENTION

In accordance with the invention, a lockstitch sewing machine is provided with a thread handling device including a pair of spaced apart parallel elongate members, and a length of easily compressible, resilient, preferably cellular material which is carried by one of the parallel members and compressed against the other. A takeup which brackets the device moves needle thread extending between the resilient material and said other member in a stitch setting direction to a temporary retention position in the device, and the thread moves free of the takeup in the opposite direction in response to a demand for thread by the sewing needle of the machine and looptaker. The length and disposition of the resilient material in the thread handling device is such as to provide for disengagement of the thread from the resilient material and thereby the cleaning of lint from the device during the final portion of the movement of the thread in said opposite direction.

DESCRIPTION OF THE DRAWINGS

FIG. 1 is a front elevational view of a head end portion of a sewing machine showing the thread handling device of the invention;

FIG. 2 is an end elevational view of the head end portion of the machine with the cover removed;

FIG. 3 is a perspective view showing the thread in various positions during descent in the thread handling device;

FIG. 4 is a view similar to FIG. 5 showing the thread in various positions during upward movement of the thread in the thread handling device;

FIG. 5 is an enlarged fragmentary front elevational view taken at the surface of the resilient material of the thread handling device and showing such material engaged by needle thread extending through the device;

FIG. 6 is an enlarged horizontal sectional view taken through the thread handling device and showing needle thread in engagement with the resilient material of the device.

DESCRIPTION OF THE PREFERRED EMBODIMENT

Referring to the drawings and in particular to FIGS. 1 and 2, reference character 10 designates a portion of a lockstitch sewing machine including a work supporting bed 12, a bracket arm 14 and sewing head 16. A needle bar 18 is carried in the sewing head for endwise reciprocation by a rotating arm shaft 20 acting through a counterbalanced crank 22, a connecting drive link 24 and finally a collar 26 which is pivotally connected to the needle bar. A sewing needle 28 is carried by the lower end portion of the needle bar 18 and cooperates with a rotary looptaker 30 journalled in the bed and driven in timed relationship to the arm shaft in a well known manner for concatenating needle thread 32 to form lockstitches with bobbin thread (not shown). A detailed description of the manner in which such lockstitches are formed may be found for example in U.S. Pat. No. 2,862,468 of R. E. Johnson for "Ornamental Stitch Sewing Machines" issued Dec. 2, 1958 and assigned to The Singer Company. A presser foot 36, affixed to a presser bar 38 is utilized to urge fabric 37 and 39 into contact with a feed dog 40 by means of which work is advanced under the needle 28. The feed dog is moved in timed relationship to the needle and looptaker by conventional work feeding mechanism which may be of the type shown and described, for example, in U.S. Pat. No. 3,527,183 for "Work Feeding Mechanism for Sewing Machines" of The Singer Company, issued Sept. 8, 1972.

Thread 32 is supplied to the needle 28 by the thread handling device 42 of the invention shown in association with a takeup member 44 and a thread tensioner 46. As shown, the thread extends from a spool 48 through a thread guide 50 and past a guide 52 to tensioner 46. The thread passes through the thread tensioner and thence into the thread handling device 42 where it passes between elongate members 54 and 56 of the device and over takeup member 44 which brackets the said members 54 and 56. Beyond thread handling device 42, the thread extends to the needle where it is threaded through the eye 58. The thread 32 is moved upwardly in the thread handling device by the takeup 44, and is moved downwardly in the device free of the takeup.

Elongate members 54 and 56 of the thread holder 42 are secured to the front face of the sewing machine by screws 60 and 62 which extend through a base 64 integral with member 54, through a head end frame 66, and into a structural support 68 that is suitably secured to elongate member 56. Elongate member 56 carries a strip of easily compressible sponge-like resilient material 70 in a slot 72 where the strip is preferably secured to the member with a suitable adhesive. Such resilient strip is compressed against member 54 and conforms at an engaging surface to the shape of the member 54 which is shown to be cylindrical in form. Thread 32 extends through the device 42 between the resilient material 70 and member 54. Preferably the resilient strip has a fine cellular structure and open cells at thread engaging surface 73 effective to subject the thread to light frictional force during movement upwardly in the thread handling device by the takeup and during movement downwardly free of the takeup. Sponge rubber and cellular polyurethane are examples of materials particularly suitable for the thread engaging resilient strip carried in member 56.

Takeup member 44 and actuating mechanism therefor correspond to like functioning mechanism shown and described in the aforementioned U.S. Pat. No. 4,263,859 of Ralph E. Johnson. As shown, the takeup member 44 is affixed to a stub arm 74 extending from one end of a link 76 which has its other end pivotally connected to crank 22. A link 78 pivotally connects at one end to the link 76 as shown, and pivotally connects at the opposite end to a fixed member 80. Rotation of the arm shaft 20 results in link 76 being driven by crank 22, and the link 76 guided in its motion by the link 78 imparts reciprocatory up-down motion to the takeup member 44 along the elongate members 54 and 56 in timed relationship to the operation of the needle 28 and looptaker 30. The takeup member 44 includes thread carrying arms 82 and 84 which extend past thread exiting and thread entering sides respectively, of the thread handling device 42, and interconnect at 86 across the front of the device. The arms 82 and 84 are angled to define thread carrying troughs 88 and 90 between diverging portions.

The thread tensioner 46 is mounted on the face of the machine by a screw 92 which engages a rigid bracket 94 of the device and extends into the sewing head 16. The thread tensioner 46 is disposed to one side of the thread handling device 42 in a position relative to the operating range of the takeup member 44 (as described in Ralph E. Johnson's U.S. Pat. No. 4,263,859). Thread 32 extending through the tensioner 46 passes around pins 96 and 98 therein and between tension applying plates. Tension applied by thread tensioner 46 may be variably controlled in accordance with the position of a knob 100 slidable along resilient member 102.

During the operation of the machine, the takeup member 44 is moved up and down in timed relation to rotation of the looptaker 30 as described in the said U.S. Pat. No. 4,263,859 of Ralph E. Johnson. When the takeup member starts to move downwardly from the top of its operating range, thread 32 in the thread handling device 42 is temporarily retained in its uppermost position therein between resilient material 70 and elongate member 54. However, as the downward movement of the takeup member 44 progresses, the thread is moved downwardly free of member 44 along resilient material 70, and member 54 in the thread handling device in response to the usual demand for thread by needle 28 and looptaker 30 as described in the said patent applications. The descending thread moving along the surface of easily compressible resilient cellular material 70 is subjected by the material to frictional force which, although light, is nevertheless sufficient to cause the thread to be forced into the looptaker hook and past bobbin case hold down means. The descending thread is eventually reengaged by takeup member 44. However, the length and disposition of the resilient material 70 in device 42 is such that the thread is disengaged from the material 70 and member 54 before such reengagement occurs. As the thread 32 is pulled off the lower end of resilient material 70, accumulated lint removed from the thread by the resilient material 70 and carried downwardly in the device by the thread is stripped by the thread from between the material 70 and member 54.

Upward movement of the takeup member 44 results in the thread 32 being moved back into device 42 between the resilient material 70 and member 54, and then upwardly to its temporary retention position in the device. As the takeup member moves upwardly in the device, slack thread cast off the looptaker is pulled upwardly by the takeup to provide for the formation of a stitch in material being sewn. The slack is quickly removed by the takeup member because the resilient material 70 exerts only a light frictional force on the thread, and so avoids excessive thread tension such as would otherwise result in slippage through the thread tensioner 46 and the pulling of thread from spool 48 in advance of stitch setting. The prompt removal of slack thread is advantageous because thread is thereby removed from the vicinity of the looptaker before it can twist and so prevent proper stitch formation.

The manufacture and assembly of the thread handling device 42 isn't hampered by the need for an adherence to close dimensional tolerances. Considerable variation in spacing between elongate members 54 and 56 along the device can be tolerated because such variations are taken up in the resilient material 70 compressed between them. As noted hereinbefore, the material 70 is easily compressible. The material may therefore be compressed a substantial amount during the fabrication of the material handling device 42 without rendering the material effective to exert more than a light frictional force on thread moving between members 54 and 70. Also, because of its easy compressibility and expandability a substantial uniform frictional force is applied by the material along the device despite the adaptations of the material to dimensional variation between members 54 and 56. Because of the light frictional force applied to the thread 32 by the material 70, there is little resulting abrasion of one by the other during either upward or downward movement of the thread in device 42. During the upward movement of the takeup, the thread is to some extent, pulled away from the resilient material 70 by the takeup as indicated in dotdash lines in FIG. 6, and there is even lesser opportunity for abrasion of the thread and resilient material.

It is to be understood that the present disclosure relates to a preferred embodiment of the invention which is for purposes of illustration only and is not to be construed as a limitation of the invention. Numerous alterations and modifications of the structure herein will suggest themselves to those skilled in the art, and all such modifications, and alterations which do not depart from the spirit and scope of the invention are intended to be included within the scope of the appended claims.

I claim:

1. In a sewing machine wherein a sewing needle and looptaker cooperate in the formation of locked stitches in a fabric, the combination comprising: a thread source; thread tensioning means to which thread extends from the thread source; a thread handling device into which the thread extends from the tensioning means and beyond which the thread extends to the needle; and a takeup for setting stitches and pulling thread through the tensioning device from the supply, the takeup being movable in one direction with thread to a stitch setting position at one end of its operating range whereat the thread is disposed for temporary retention by said device, and moveable in the opposite direction free of the thread to the other end of said operating range to permit thread to move in the thread handling device away from the temporary retention position to a position of reengagement with the takeup at said other end of its operating range and during such movement shorten the path for thread between the tensioning device and needle to supply a quantity of thread for use by the needle and looptaker; said thread handling device including a pair of elongate members, and a length of resilient material therebetween, the resilient material being carried by one of the elongate members and being compressed against the other member, the thread in the holder being located between the resilient material and the said other member, and said thread having frictional force applied thereto by the resilient material during movement of the thread in the threadhandling device.

2. The combination of claim 1 wherein the resilient material has a cellular structure.

3. The combination of claim 2 wherein the resilient material is polyurethane.

4. The combination of claim 1 wherein the resilient material is secured to said one elongate member with an adhesive.

5. The combination of claim 1 wherein the resilient material is retained in a slot in said one elongate member.

6. The combination of claim 1 wherein said other elongate member is cylindrical and the resilient material is compressed against the said other elongate member and is conformed at an opposing surface to the cylindrical curvature.

7. The combination of claim 6 wherein the takeup pulls thread away from the resilient material during movement in the stitch setting direction to reduce abrasion of the resilient material by the thread and of the thread by the resilient material.

8. The combination of claim 1 wherein the resilient material has a predetermined length and disposition in the thread handling device providing for engagement of the thread by said resilient material when the thread is in the temporary retention position in said device and during only a portion of the movement of the thread in the device toward and away from said temporary position.

9. The combination of claim 8 wherein the predetermined length and disposition of the resilient material provides for disengagement of the thread from the resilient material during movement of the thread away from the temporary retention position and reengagement during movement toward such position.

* * * * *